US008502847B2

(12) United States Patent
Sato et al.

(10) Patent No.: US 8,502,847 B2
(45) Date of Patent: Aug. 6, 2013

(54) ADHESIVE LABEL ISSUING DEVICE AND PRINTER

(75) Inventors: Yoshinori Sato, Chiba (JP); Kazuo Tani, Chiba (JP); Norimitsu Sanbongi, Chiba (JP)

(73) Assignee: Seiko Instruments Inc., Chiba (JP)

( * ) Notice: Subject to any disclaimer, the term of this patent is extended or adjusted under 35 U.S.C. 154(b) by 19 days.

(21) Appl. No.: 13/404,541

(22) Filed: Feb. 24, 2012

(65) Prior Publication Data

US 2012/0249713 A1 Oct. 4, 2012

(30) Foreign Application Priority Data

Mar. 28, 2011 (JP) ..... 2011-070541

(51) Int. Cl.
*B41J 2/32* (2006.01)
*G09F 3/10* (2006.01)

(52) U.S. Cl.
USPC ..... 347/218; 400/120.01

(58) Field of Classification Search
USPC ..... 347/218, 171; 400/120.01
See application file for complete search history.

(56) References Cited

U.S. PATENT DOCUMENTS 6,867,792 B2 * 3/2005 Hoshino et al. ..... 347/218
7,106,354 B2 * 9/2006 Sato et al. ..... 347/171
7,168,870 B2 * 1/2007 Sato et al. ..... 400/120.01
7,213,993 B2 * 5/2007 Takahashi et al. ..... 400/619
7,275,880 B2 * 10/2007 Obuchi et al. ..... 400/120.01
7,444,407 B2 * 10/2008 Thomas ..... 709/227
7,458,407 B2 * 12/2008 Takahashi et al. ..... 156/359
7,478,956 B2 * 1/2009 Sanbongi et al. ..... 400/611
7,556,445 B2 * 7/2009 Takahashi et al. ..... 400/120.01
7,579,573 B2 * 8/2009 Kohira et al. ..... 219/388
7,901,151 B2 * 3/2011 Sato et al. ..... 400/659
8,277,879 B2 * 10/2012 Sato et al. ..... 427/180

FOREIGN PATENT DOCUMENTS

JP 2003-316265 A 11/2003

* cited by examiner

*Primary Examiner* — Huan Tran
(74) *Attorney, Agent, or Firm* — Brinks Hofer Gilson & Lione

(57) ABSTRACT

A printer includes: a cutter unit for cutting a label sheet to obtain an adhesive label with a desired length by allowing the label sheet to pass through the cutter unit; an adhesive strength exhibiting unit for allowing the adhesive label to exhibit adhesive strength by heating the adhesive label; a sheet loosening unit placed on a downstream side of the cutter unit and an upstream side of the adhesive strength exhibiting unit in a sheet transporting direction; and a sheet-passage direction changing unit for changing the sheet-passage direction in the upstream sheet-passage part by changing a direction of the upstream sheet-passage part from a reference position at which a sheet-passage direction in the upstream sheet-passage part is placed on the same line as a sheet-passage direction in the downstream sheet-passage part to an inclined position at which the direction is inclined from the reference position.

8 Claims, 5 Drawing Sheets

ADHESIVE LABEL ISSUING DEVICE AND PRINTER

RELATED APPLICATIONS

This application claims priority under 35 U.S.C. §119 to Japanese Patent Application No. 2011-070541 filed on Mar. 28, 2011, the entire content of which is hereby incorporated by reference.

BACKGROUND OF THE INVENTION

1. Field of the Invention

The present invention relates to an adhesive label issuing device that issues an adhesive label, and a printer including the adhesive label issuing device.

2. Description of the Related Art

Conventionally, for example, as a label sheet for adhesive labels used for, for example, a POS label for food, a logistics/transportation label, a medical label, a baggage tag, and an indication label for bottles and cans, a linerless type label sheet not using a liner (separator) has been known. As the linerless type label sheet, in general, there is a silicon top type label sheet in which the surface of a label recording surface is coated with a release agent such as a silicon resin, to thereby prevent adhesion between the recording surface and an adhesive layer provided on a rear surface of the recording surface when the label is rolled into a roll shape. In recent years, there has been known a label sheet in which a thermally activated adhesive layer, which exhibits adhesiveness by heating, is provided on a rear surface of a label having a recording surface of a thermosensitive color-developing type. In the label sheet having an adhesive layer made of a thermally activated adhesive, the recording surface is allowed to develop color with heat to print a bar-code, characters, etc. thereon, and the thermally activated adhesive layer is allowed to exhibit adhesive strength by heating.

Further, in recent years, in addition to a label sheet provided with the above-mentioned thermally activated adhesive layer, a label sheet has been proposed in which a liner is omitted by covering the surface of an adhesive layer of the label sheet with a coating layer. In this label sheet, the coating layer on the rear surface of the label is heated, to thereby remove the coating layer to expose the adhesive layer. Consequently, adhesive strength can be exhibited.

Japanese Patent Application Laid-Open No. 2003-316265 describes an example of a printer for printing/issuing an adhesive label through use of the above-mentioned label sheet having the thermally activated adhesive layer formed therein or the above-mentioned label sheet in which the surface of the adhesive layer is covered with the coating layer. It is known that this type of the printer includes a roll accommodating part for accommodating a sheet roll obtained by rolling a band-shaped linerless type label sheet into a roll shape, a printing unit for performing printing by heating the label sheet unrolled from the sheet roll from the thermosensitive color-developing surface side, a cutter unit for cutting the printed label sheet to obtain an adhesive label with a desired length by allowing the label sheet to pass therethrough, and an adhesive strength exhibiting unit for allowing the label sheet to exhibit adhesive strength by heating an adhesive layer. The printing unit and the adhesive strength exhibiting unit described above respectively include a thermal head and a platen roller, and are configured to: perform printing when a printing surface of the label sheet passes through a region between the thermal head and the platen roller of the printing unit; and thermally activate the adhesive layer when the label sheet passes through a region between the thermal head and the platen roller of the adhesive strength exhibiting unit, or remove the coating layer on the surface of the adhesive layer to allow the adhesive label to exhibit adhesive strength.

By the way, in the above-mentioned printer, when the label sheet is cut by the cutter unit, the label sheet is cut at a right angle with respect to the length direction of the sheet, and hence it is necessary to stop the transportation of the label sheet temporarily so as to perform a cutting operation. If a portion to be the trailing end of the adhesive label is cut by the cutter unit, the leading end of the label sheet (adhesive label) has proceeded up to the position of the thermal head of the adhesive strength exhibiting unit. When the label sheet (adhesive label) remains inserted between the thermal head and the platen roller of the adhesive strength exhibiting unit, the label sheet is pulled by the platen roller of the adhesive strength exhibiting unit. Therefore, it is necessary to stop the transportation of the label sheet (adhesive label) temporarily. In this case, there is a fear that the thermosensitive color-developing surface is discolored with heat from the thermal head (heat source) of the adhesive strength exhibiting unit, and the thermally activated adhesive layer may adhere to the thermal head to cause transportation defects such as sheet jam.

Then, as for the above-mentioned conventional printer, there is proposed a configuration in which a sheet loosening unit for loosening the label sheet is provided between the cutter unit and the adhesive strength exhibiting unit. The sheet loosening unit includes an upstream sheet-passage part (guide) which is placed on the downstream side in the sheet transporting direction of the cutter unit and through which the label sheet passes, and a downstream sheet-passage part (guide) which is placed on the upstream side in the label transporting direction of the adhesive strength exhibiting unit and through which the label sheet passes. The upstream sheet-passage part and the downstream sheet-passage part described above are respectively placed so that the respective sheet-passage directions are aligned on the same line, and the label sheet passed from the upstream sheet-passage part to the downstream sheet-passage part can be loosened between the upstream sheet-passage part and the downstream sheet-passage part. Thus, when the adhesive label with a large length is issued, the label sheet is sent while being loosened between the upstream sheet-passage part and the downstream sheet-passage part, with the result that the label sheet can proceed without being stopped in the adhesive strength exhibiting unit positioned on the downstream side during cutting of the label sheet.

Further, in the above-mentioned adhesive label issuing device, although it is not necessary to loosen the label sheet when the length of the adhesive label is small, the adhesive label needs to have at least a length from a blade tip position of the cutter unit to the downstream sheet-passage part.

In the above-mentioned conventional printer (adhesive label issuing device), when the label sheet is loosened too much between the upstream sheet-passage part and the downstream sheet-passage part, a loosened portion of the label sheet is bent in the middle to enter the downstream sheet-passage part, which may cause transportation defects such as sheet jam. In particular, at low temperature (for example, 5° C. or less), the label sheet becomes hard, and hence the loosened part of the label sheet is bent easily. Thus, it is necessary to limit the length of the adhesive label to be issued by the adhesive label issuing device to such a length that the loosened part of the label sheet is not bent.

Further, as the interval between the upstream sheet-passage part and the downstream sheet-passage part is enlarged, bending of the loosened part of the label sheet can be prevented even when the label sheet is loosened greatly. In this case, although the upper limit of the length of the adhesive label becomes larger, the lower limit of the length of the adhesive label becomes larger by the enlarged interval between the upstream sheet-passage part and the downstream sheet-passage part. On the contrary, as the interval between the upstream sheet-passage part and the downstream sheet-passage part is narrowed, the lower limit of the length of the adhesive label becomes smaller. However, the upper limit of the length of the adhesive label becomes smaller because the loosened part of the label sheet is bent easily. Thus, in the above-mentioned conventional adhesive label issuing device, the freedom degree of the length of the adhesive label is low.

The present invention has been made to solve the above-mentioned conventional problems, and it is an object of the present invention to provide an adhesive label issuing device and a printer capable of enhancing reliability by preventing transportation defects of a label sheet, enhancing a degree of freedom of a length of an adhesive label, and realizing reduction in size.

SUMMARY OF THE INVENTION

An adhesive label issuing device according to the present invention includes a cutter unit for cutting a label sheet having a band shape, in which an adhesive layer is provided on a reverse side of a thermosensitive color-developing surface of thermosensitive paper, to obtain an adhesive label with a desired length by allowing the label sheet to pass through the cutter unit, an adhesive strength exhibiting unit for allowing the adhesive label to exhibit adhesive strength by heating the adhesive label from the reverse side of the thermosensitive color-developing surface, and a sheet loosening unit placed on a downstream side of the cutter unit and an upstream side of the adhesive strength exhibiting unit in a sheet transporting direction, for loosening the label sheet having passed through the cutter unit without being cut between an upstream sheet-passage part and a downstream sheet-passage part that respectively allow the label sheet to pass therethrough. The upstream sheet-passage part has a reference position at which a sheet-passage direction in the upstream sheet-passage part is placed on the same line as a sheet-passage direction in the downstream sheet-passage part. The adhesive label issuing device further includes sheet-passage direction changing means for changing the sheet-passage direction in the upstream sheet-passage part by changing a direction of the upstream sheet-passage part from the reference position to an inclined position at which the direction is inclined from the reference position.

Due to the above-mentioned feature, when the adhesive label is issued, the label sheet is first unrolled successively to be transported. At this time, the upstream sheet-passage part is at the reference position, and the sheet-passage direction in the upstream sheet-passage part and the sheet-passage direction in the downstream sheet-passage part are placed on the same line. Therefore, the downstream sheet-passage part is present on the front side in the sheet-passage direction in the upstream sheet-passage part, and the label sheet is transferred easily from the upstream sheet-passage part to the downstream sheet-passage part. That is, the leading end of the label sheet proceeds straight after being sent from the upstream sheet-passage part to reach the downstream sheet-passage part. After that, the label sheet is unrolled until the cut position of the label sheet as the trailing end of the adhesive label reaches the blade tip position of the cutter unit. At this time, the label sheet is loosened between the upstream sheet-passage part and the downstream sheet-passage part, with the result that the leading end of the label sheet can be prevented from proceeding to the position of a heat source of the adhesive strength exhibiting unit and the operation of the adhesive strength exhibiting unit can be continued even during the operation of the cutter unit (described later). In this case, the direction of the upstream sheet-passage part is changed from the reference position to the inclined position by the sheet-passage direction changing means after the leading end of the label sheet passes through at least the downstream sheet-passage part, to thereby change the sheet-passage direction in the upstream sheet-passage part. As a result, a loosened part is not bent easily even when the loosened amount of the label sheet increases and the transportation defects are prevented. After that, when the cut position of the label sheet as the trailing end of the adhesive label proceeds to the blade tip of the cutter unit, the transportation of the label sheet is stopped temporarily at least in the upstream sheet-passage part, and the portion as the trailing end of the adhesive label is cut by the cutter unit to form an adhesive label with a desired length. Then, the adhesive label is transported to the adhesive strength exhibiting unit and the adhesive label is allowed to exhibit adhesive strength by the adhesive strength exhibiting unit to be issued.

Further, in the adhesive label issuing device according to the present invention, it is preferred that the upstream sheet-passage part include a pair of transporting rollers, and the label sheet be allowed to pass through a region between the pair of transporting rollers.

Due to the above-mentioned feature, the label sheet having passed through the region between the pair of transporting rollers is sent and transported toward the downstream sheet-passage part due to the rotation of the transporting rollers. Further, the rotation of the transporting rollers causes the label sheet to be loosened between the upstream sheet-passage part and the downstream sheet-passage part.

Further, in the adhesive label issuing device according to the present invention, it is preferred that one of the pair of transporting rollers be a drive roller and another of the pair of transporting rollers be a driven roller following the drive roller, and the sheet-passage direction changing means include a turning mechanism for turning the driven roller around a rotation center shaft line of the drive roller to move the driven roller between the reference position and the inclined position.

Due to the above-mentioned feature, the direction of the upstream sheet-passage part including the drive roller and the driven roller is changed by turning the driven roller around the rotation center shaft line of the drive roller by the turning mechanism. Therefore, the sheet-passage direction of the label sheet passing through the region between the drive roller and the driven roller can be changed with a simple mechanism.

Further, in the adhesive label issuing device according to the present invention, it is preferred that the turning mechanism include a guide hole which extends in an arc shape with the rotation center shaft line of the drive roller being a center and in which a shaft part of the driven roller is inserted, a locking part for locking the driven roller placed at the reference position, and a release mechanism for moving the locking part in a direction in which the locking part is removed from the driven roller, to thereby release locking of the locking part with respect to the driven roller.

Due to the above-mentioned feature, when the locking part is removed from the driven roller by the release mechanism and the drive roller is rotated, the driven roller is turned around the rotation center shaft line of the drive roller along the guide hole due to the rotation force of the drive roller, and the direction of the upstream sheet-passage part including the drive roller and the driven roller is changed from the reference position to the inclined position. Further, the drive roller is rotated reversely while the driven roller is placed at the inclined position, with the result that the driven roller is turned around the rotation center shaft line of the drive roller along the guide hole due to the rotation force of the drive roller, and the direction of the upstream sheet-passage part is returned from the inclined position to the reference position. Then, when the driven roller is locked by the locking part, the direction of the upstream sheet-passage part is maintained at the reference position. Thus, with a simple configuration, the driven roller can be turned around the rotation center shaft line of the drive roller between the reference position and the inclined position.

Further, it is preferred that a printer according to the present invention include the above-mentioned adhesive label issuing device, and a printing unit provided on an upstream side in the sheet transporting direction of the cutter unit, for performing printing on the thermosensitive color-developing surface by heating the label sheet from the thermosensitive color-developing surface side.

Due to the above-mentioned feature, first, printing is performed on the thermosensitive color-developing surface of the unrolled label sheet by the printing unit. After that, the printed label sheet passes through the cutter unit to be cut to the adhesive label with a desired length, and the adhesive label is allowed to exhibit adhesive strength by the adhesive strength exhibiting unit to be issued.

Further, it is preferred that the printer according to the present invention include the above-mentioned adhesive label issuing device, and a printing unit provided on a downstream side in the sheet transporting direction of the downstream sheet-passage part and an upstream side in the sheet transporting direction of the adhesive strength exhibiting unit, for performing printing on the thermosensitive color-developing surface by heating the adhesive label from the thermosensitive color-developing surface side.

Due to the above-mentioned feature, first, the unrolled label sheet passes through the cutter unit to be cut to the adhesive label with a desired length. After that, the adhesive label is transported to the printing unit, and printing is performed on the thermosensitive color-developing surface of the adhesive label by the printing unit. Then, the printed adhesive label is allowed to exhibit adhesive strength by the adhesive strength exhibiting unit to be issued.

In the adhesive label issuing device and the printer according to the present invention, the following effects can be obtained. The direction of the upstream sheet-passage part is changed from the reference position to the inclined position by the sheet-passage direction changing means to change the sheet-passage direction of the upstream sheet-passage part. As a result, the loosened part is not bent easily even when the loosened amount of the label sheet increases and the transportation defects such as sheet jam are prevented. Therefore, the reliability of the adhesive label issuing device can be enhanced. Further, the degree of freedom of the length of the adhesive label can be enhanced, and the adhesive label issuing device can be downsized.

DETAILED DESCRIPTION OF THE PREFERRED EMBODIMENTS

Hereinafter, embodiments of an adhesive label issuing device and a printer according to the present invention are described with reference to the drawings.

First Embodiment

Figure 1:
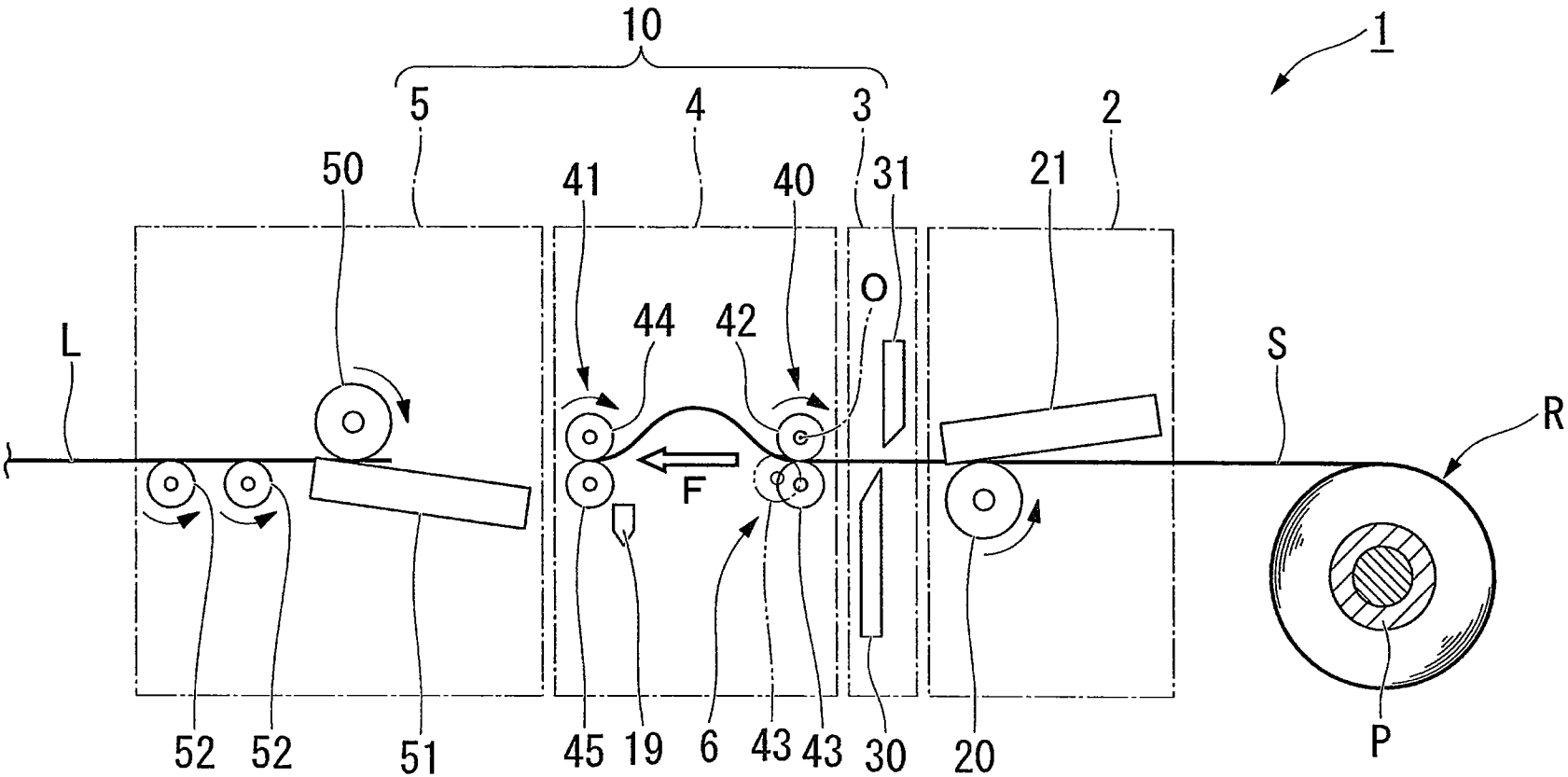
FIG. 1 is a schematic view of a printer illustrating a first embodiment of the present invention.

A printer 1 illustrated in FIG. 1 according to a first embodiment of the present invention is a label printer which is configured to use a sheet roll R for an adhesive label, print a bar-code, a price, etc. on a band-shaped label sheet S unrolled from the sheet roll R, cut the label sheet S to obtain an adhesive label L with a desired length, and issue the adhesive label L.

The above-mentioned sheet roll R has a configuration in which the band-shaped label sheet S is rolled around an outer circumferential surface of a cylindrical core material P and is accommodated and held in a roll accommodating part (not shown) so as to be axially rotatable. Further, the label sheet S has a configuration in which an adhesive layer made of a thermally activated adhesive is provided on a rear surface (surface on an opposite side of a thermosensitive color-developing surface) of special recording paper (thermosensitive paper) that is discolored with the application of heat.

First, the configuration of the above-mentioned printer 1 is described.

As the schematic configuration, as illustrated in FIG. 1, the printer 1 includes a printing unit 2 for performing printing on the thermosensitive color-developing surface of the label sheet S unrolled from the sheet roll R by heating the thermosensitive color-developing surface, a cutter unit 3 for cutting the label sheet S to a desired length, a sheet loosening unit 4 for loosening the label sheet S having passed through the cutter unit 3, and an adhesive strength exhibiting unit 5 for allowing the adhesive label L to exhibit adhesive strength by heating an adhesive layer of the adhesive label L cut by the cutter unit 3. The cutter unit 3, the sheet loosening unit 4, and the adhesive strength exhibiting unit 5 described above constitute an adhesive label issuing device 10.

(Printing Unit)

The printing unit 2 is a thermal print mechanism including a platen roller 20 and a printing thermal head 21, and is placed on a downstream side in a sheet transporting direction of a roll accommodating part (not shown) for accommodating the sheet roll R. The printing thermal head 21 is a line head including a large number of heating elements, and is pressed against the platen roller 20 side with a coil spring or the like (not shown) to be provided in press contact with an outer circumferential surface of the platen roller 20. A driven gear (not shown) is fixed to one end of the platen roller 20. The driven gear meshes with a gear transmission mechanism to be driven by a drive source such as a motor (not shown), and the power of the drive source is transmitted to the platen roller 20 through the gear transmission mechanism and the driven gear. In the printing unit 2, the platen roller 20 is rotated by driving the drive source under a state in which the label sheet S is sandwiched between the platen roller 20 and the printing thermal head 21. In this manner, the label sheet S can be unrolled from the sheet roll R to be transported. The label sheet S is fed between the platen roller 20 and the printing thermal head 21 with the thermosensitive color-developing surface facing the printing thermal head 21 side.

(Cutter Unit)

The cutter unit 3 is a cutting mechanism including a fixed blade 30 and a movable blade 31, and is placed on a downstream side in the sheet transporting direction of the printing unit 2. The fixed blade 30 is placed on the adhesive layer side of the label sheet S, and the movable blade 31 is placed on the thermosensitive color-developing surface side of the label sheet S. Note that, the fixed blade 30 may be placed on the thermosensitive color-developing surface side of the label sheet S, and the movable blade 31 may be placed on the adhesive layer side of the label sheet S. The movable blade 31 is slidable so as to approach or be separated from the fixed blade 30 and is capable of cutting the label sheet S while sandwiching the label sheet S between the fixed blade 30 and the movable blade 31.

(Sheet Loosening Unit)

The sheet loosening unit 4 is a loosening region part for loosening the label sheet S having passed through the cutter unit 3 between an upstream sheet-passage part 40 and a downstream sheet-passage part 41, and is placed on a downstream side in the sheet transporting direction of the cutter unit 3. The upstream sheet-passage part 40 and the downstream sheet-passage part 41 are respectively formed of a pair or transporting rollers (i.e., drive rollers 42, 44 and driven rollers 43, 45) for transporting the label sheet S (adhesive label L cut by the cutter unit 3) having passed through the cutter unit 3. The label sheet S is fed between the drive rollers 42, 44 and the driven rollers 43, 45. As a material for at least a portion of the outer circumferential surfaces of the drive rollers 42, 44 and the driven rollers 43, 45, which is brought into contact with the label sheet S, a rubber-based material such as silicone rubber or fluorine rubber is suitable.

The drive rollers 42, 44 are driven by a drive source such as a motor, and a driven gear (not shown) is fixed to each one end of the drive rollers 42, 44. The driven gear meshes with the gear transmission mechanism that is driven by the drive source such as a motor (not shown), and the power of the drive source is transmitted to the drive rollers 42, 44 through the gear transmission mechanism and the driven gear. Further, the rotatable driven rollers 43, 45 placed in parallel with the drive rollers 42, 44 are provided outside in a radial direction of the drive rollers 42, 44, and the outer circumferential surfaces of the driven rollers 43, 45 are provided in press contact with the outer circumferential surfaces of the drive rollers 42, 44 with rubber elasticity, a plate spring (not shown), or the like. Thus, when the drive rollers 42, 44 are rotated by driving the drive source, the driven rollers 43, 45 rotate in an opposite direction to the rotation direction of the drive rollers 42, 44, following the rotation of the drive rollers 42, 44. At this time, when the label sheet S is fed between the drive rollers 42, 44 and the driven rollers 43, 45, the label sheet S is sent out to be transported by the rotating drive rollers 42, 44 and driven rollers 43, 45. Further, the drive rollers 42, 44 are placed on the thermosensitive color-developing surface side of the label sheet S, and the driven rollers 43, 45 are placed on the adhesive layer side of the label sheet S. Note that, the drive rollers 42, 44 may be placed on the adhesive layer side of the label sheet S, and the driven rollers 43, 45 may be placed on the thermosensitive color-developing surface side of the label sheet S.

Further, the upstream sheet-passage part 40 is placed at a reference position (indicated by a solid line in FIG. 1) when the sheet-passage direction in the upstream sheet-passage part 40 is directed on the line identical to the sheet-passage direction in the downstream sheet-passage part 41, and an outlet of the upstream sheet-passage part 40 and an inlet of the downstream sheet-passage part 41 are opposed to each other with an interval therebetween. The above-mentioned "sheet-passage direction" refers to a direction orthogonal to virtual straight lines connecting the rotation centers of the drive rollers 42, 44 to the rotation centers of the driven rollers 43, 45, which is indicated by the arrow F in FIG. 1.

Further, the sheet loosening unit 4 is includes sheet-passage direction changing means 6 for changing the sheet-passage direction in the upstream sheet-passage part 40 by changing the direction of the upstream sheet-passage part 40 to an inclined position (indicated by an alternate long and short dash line in FIG. 1) at which the direction is inclined from the above-mentioned reference position. The sheet-passage direction changing means 6 includes a turning mechanism 11 (illustrated in FIGS. 2A and 2B) for moving the driven roller 43 of the upstream sheet-passage part 40 between the reference position and the inclined position by turning the driven roller 43 around a rotation center shaft line O of the drive roller 42.

Hereinafter, the turning mechanism 11 is described in detail with reference to FIGS. 2A, 2B, 3, and 4.

As illustrated in FIGS. 2A, 2B, 3, and 4, frame plates 15, 15 placed perpendicular to the rotation center shaft line O of the drive roller 42 are respectively provided on both axial sides of the drive roller 42 and both axial sides of the driven roller 43 of the upstream sheet-passage part 40. The pair of frame plates 15, 15 are placed so as to be opposed to each other with an interval, and the drive roller 42 and the driven roller 43 described above are respectively provided between the pair of frame plates 15, 15. Both ends of a shaft part 42*a* of the drive roller 42 are respectively supported by the pair of frame plates 15, 15 so as to axially rotatable.

Figure 2A:
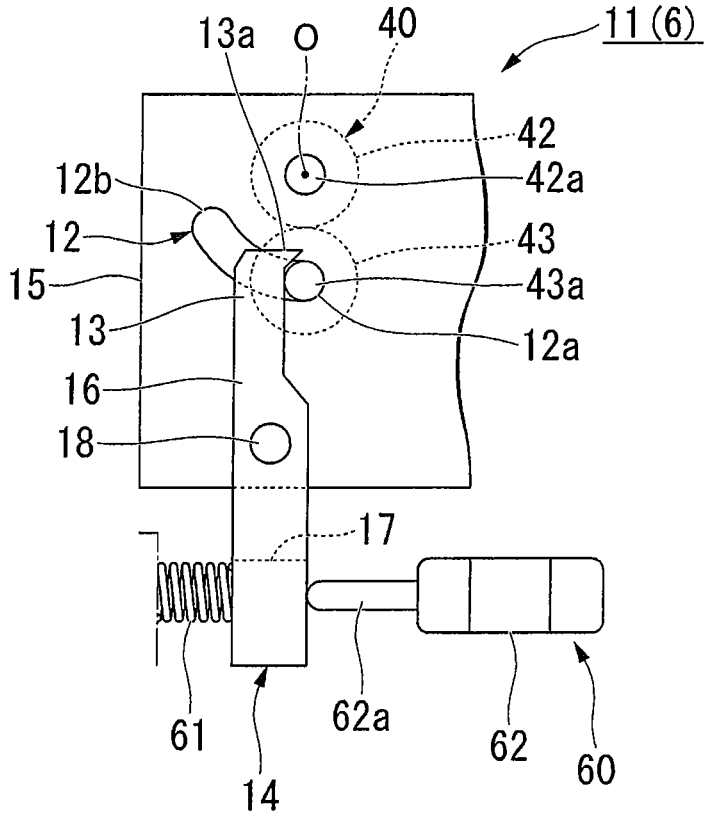
FIGS. 2A and 2B are side views of sheet-passage direction changing means (turning mechanism), which illustrate the first embodiment of the present invention.
Figure 2B:
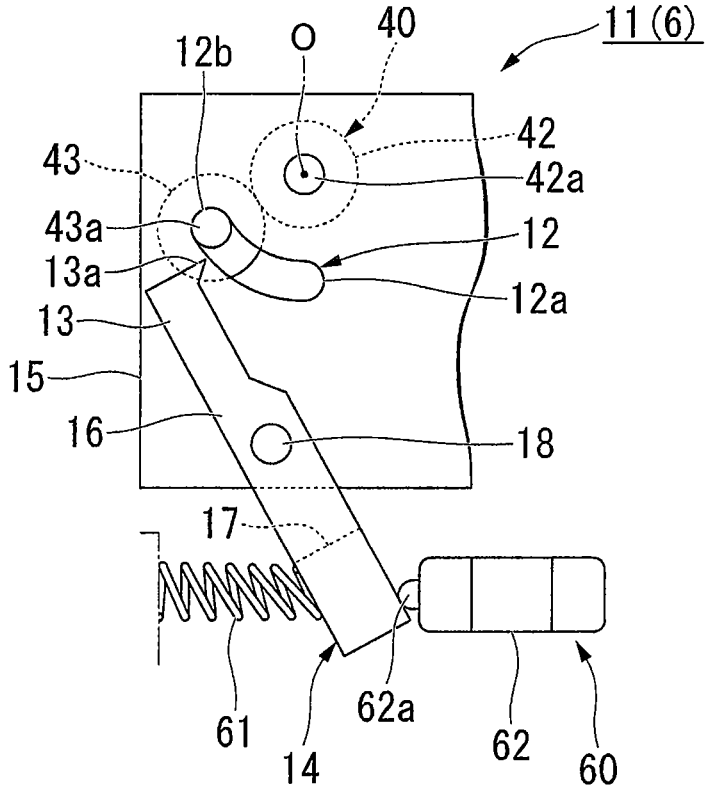
Figure 3:
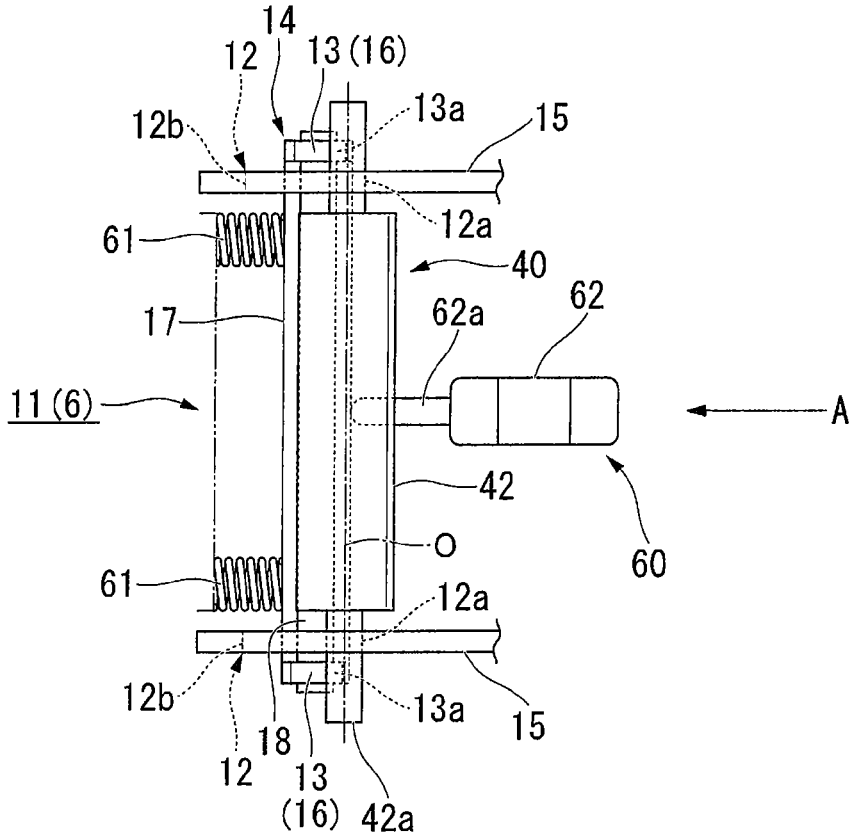
FIG. 3 is a plan view of the sheet-passage direction changing means (turning mechanism), which illustrates the first embodiment of the present invention.
Figure 4:
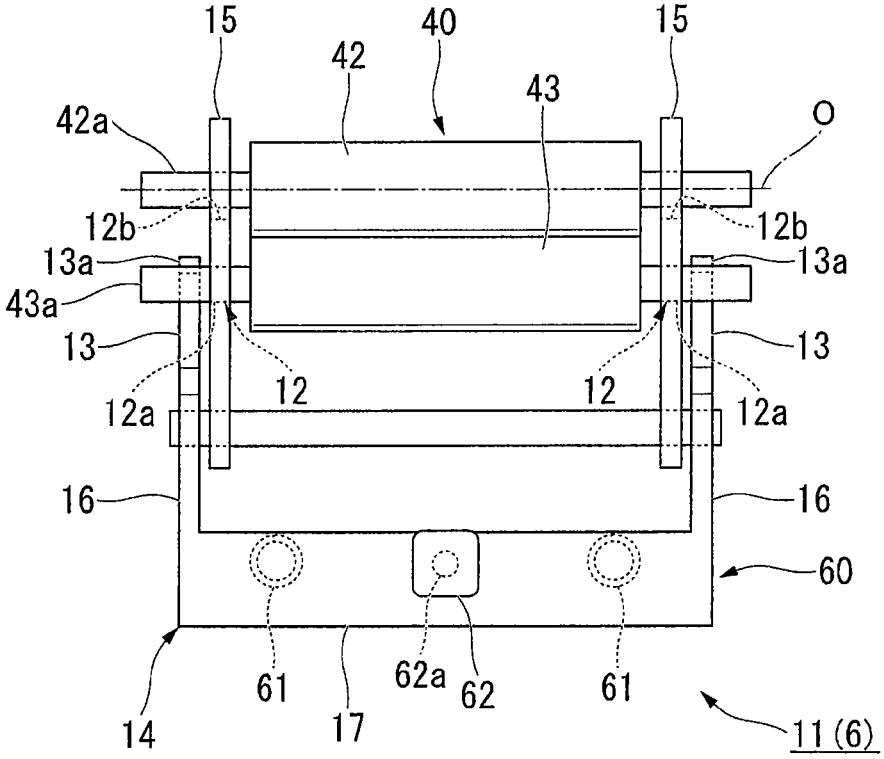
FIG. 4 is a front view of the sheet-passage direction changing means (turning mechanism), which illustrates the first embodiment of the present invention and is viewed from an arrow A illustrated in FIG. 3.

Further, the above-mentioned pair of frame plates 15, 15 are respectively provided with guide holes 12, 12 in which the ends of a shaft part 43*a* of the driven roller 43 are inserted to guide the movement direction of the driven roller 43. The guide holes 12, 12 are formed in the same shape and placed at positions opposed to each other. Specifically, the guide hole 12 is a long hole extending in an arc shape with the rotation center shaft line O of the drive roller 42 being the center and extends diagonally upward in an arc shape from the position vertically below the drive roller 42 toward the upstream in the sheet-passage direction (left side in FIGS. 2A and 2B). Then, both the ends of the shaft part 43*a* of the driven roller 43 are respectively inserted in inner sides of the guide holes 12, 12 on both sides, and the shaft part 43*a* of the driven roller 43 is capable of moving along the guide hole 12. Thus, the driven roller 43 is capable of moving in an arc shape along the outer circumferential surface of the drive roller 42. Further, as illustrated in FIG. 2A, the shaft part 43*a* of the driven roller 43 is locked at one end 12*a* (end vertically below the drive roller 42) in the length direction of the guide hole 12, with the result that the driven roller 43 is positioned at the above-mentioned reference position. Further, as illustrated in FIG. 2B, the shaft part 43*a* of the driven roller 43 is locked at the other end 12*b* in the length direction of the guide hole 12, with the result that the driven roller 43 is positioned at the above-mentioned inclined position.

Further, as illustrated in FIGS. 2A, 2B, 3, and 4, a lever member 14 that swings along the surfaces perpendicular to the rotation center shaft line O is attached to the above-mentioned pair of frame plates 15, 15. The lever member 14 is formed into a substantially U-shape, and as the schematic configuration, the lever member 14 includes a pair of arm parts 16, 16 axially supported by the pair of frame plates 15, 15 so as to be rotatable through a rotary shaft part 18, and a connecting part 17 connecting one ends (lower ends in FIGS. 2A and 2B) of the pair of arm parts 16, 16. The pair of arm parts 16, 16 are members extending along the pair of frame plates 15, 15 and formed into the same shape. Further, the pair of arm parts 16, 16 are respectively provided on outer surface sides of the above-mentioned pair of frame plates 15, 15, and are provided at positions opposed to each other with the pair of frame plates 15, 15 interposed therebetween. The above-mentioned rotary shaft part 18 is inserted in a shaft through-hole (not shown) formed in the pair of frame plates 15, 15 so as to be rotatable, and extends between intermediate parts in the length direction of the pair of arm parts 16.

Locking parts 13, 13 for locking the driven roller 43 at the above-mentioned reference position are respectively provided at the other ends (upper ends in FIG. 2) of the pair of arm parts 16, 16. The locking part 13 is a regulating member for regulating the movement of the shaft part 43*a* of the driven roller 43 toward the other end 12*b* side by abutting against the end of the shaft part 43*a* of the driven roller 43 at the position (reference position) of the one end 12*a* in the length direction of the guide hole 12 from a front side (other end 12*b* side in the length direction of the guide hole 12, that is, left side in FIGS. 2A and 2B). A claw part 13*a* to be hooked on the end of the shaft part 43*a* of the driven roller 43 is formed at an upper end of the locking part 13. Further, when the above-mentioned lever member 14 swings around the rotary shaft part 18, the locking part 13 moves between a position (locking position) at which the shaft part 43*a* of the driven roller 43 at the reference position is locked and a position (release position) out of a turning orbit (guide hole 12) of the shaft part 43*a*.

Further, the turning mechanism 11 includes a release mechanism 60 for moving the locking part 13 in the direction in which the locking part 13 is removed from the driven roller 43, to thereby release the locking of the locking part 13 with respect to the driven roller 43. The release mechanism 60 includes a biasing member 61 for biasing the lever member 14 in the direction in which the locking part 13 moves from the above-mentioned locking position to the release position, and a solenoid 62 for pressing the lever member 14 in the direction in which the locking part 13 moves from the above-mentioned release position to the locking position against the biasing force of the biasing member 61.

The biasing member 61 is a compression coil spring inserted between the connecting part 17 and a fixing part (not shown) provided in front of the connecting part 17, and is compressed when the locking part 13 is placed at the locking position to press the connecting part 17 backward with a spring force (restoring force).

The solenoid 62 is placed at the back of the connecting part 17 (on an opposite side of the biasing member 61) in such a manner that a movable part 62*a* protrudes toward the front side (connecting part 17 side), and the tip end of the movable part 62*a* of the solenoid 62 abuts against the connecting part 17 from the back side of the connecting part 17. When the solenoid 62 is driven and the movable part 62*a* proceeds, the connecting part 17 is pressed toward the front side and the lever member 14 is turned in the locking direction (in the direction in which the locking part 13 moves from the release position to the locking position) against the biasing force of the biasing member 61. Further, when the driving of the solenoid 62 is stopped and the movable part 62*a* retracts, the pressing force against the connecting part 17 is released. Consequently, due to the biasing force of the biasing member 61, the lever member 14 is turned in the locking release direction (in the direction in which the locking part 13 moves from the locking position to the release position).

Further, as illustrated in FIG. 1, the above-mentioned sheet loosening unit 4 includes an optical sensor 19 for detecting that the leading end of the label sheet S has reached the downstream sheet-passage part 41. The optical sensor 19 is a reflection-type or transmission-type sensor, and is provided in the vicinity of the upstream side in the sheet-passage direction of the downstream sheet-passage part 41. As detecting means for detecting that the leading end of the label sheet S has reached the downstream sheet-passage part 41, means other than those using the above-mentioned optical sensor 19 may be used. For example, the arrival of the leading end of the label sheet S can be detected through use of a micro-switch or by calculating the amount of sheet feed of the label sheet S.

(Adhesive Strength Exhibiting Unit)

As illustrated in FIG. 1, the adhesive strength exhibiting unit 5 includes a platen roller 50 and a thermal head 51 for exhibiting adhesive strength, and is placed on the downstream side in the sheet transporting direction of the sheet loosening unit 4. The thermal head 51 for exhibiting adhesive strength is a line head including a large number of heating elements (not shown), and is pressed against the platen roller 50 side with a coil spring or the like (not shown) to be provided in press contact with an outer circumferential surface of the platen roller 50. A driven gear (not shown) is fixed at one end of the platen roller 50. The driven gear meshes with a gear transmission mechanism to be driven by a drive source such as a motor (not shown), and the power of the drive source is transmitted to the platen roller 50 through the gear transmission mechanism and the driven gear. In the adhesive strength exhibiting unit 5, the platen roller 50 is rotated by driving the drive source under a state in which the adhesive label L is sandwiched between the platen roller 50 and the thermal head 51 for exhibiting adhesive strength. In this manner, the adhesive label L can be transported. The adhesive strength exhibiting unit 5 has almost the same configuration as that of the printing unit 2 as described above. However, the positions of the platen roller 50 and the thermal head 51 for exhibiting adhesive strength are opposite with respect to the printing unit 2, and the adhesive label L is fed between the platen roller 50 and the thermal head 51 for exhibiting adhesive strength with the thermosensitive color-developing surface facing the platen roller 50 side.

Further, discharge rollers 52 for transporting the adhesive label L having exhibited adhesive strength to a discharge port (not shown) are provided on the downstream side in the sheet transporting direction of the above-mentioned platen roller 50 and thermal head 51 for exhibiting adhesive strength. A driven gear (not shown) is fixed at each one end of the discharge rollers 52, and the driven gear meshes with a gear transmission mechanism that is driven by a drive source such as a motor (not shown). The power of the drive source is transmitted to the discharge rollers 52 through the gear transmission mechanism and the driven gear.

The driven gear (not shown) fixed at one end of the platen roller 20 of the printing unit 2, the driven gear (not shown) fixed at each one end of the two drive rollers 42, 44 of the sheet loosening unit 4, the driven gear (not shown) fixed at one end of the platen roller 50 of the adhesive strength exhibiting unit 5, and the driven gear (not shown) fixed at each one end of the discharge rollers 52 respectively mesh with the common gear transmission mechanism, and the platen roller 20 of the printing unit 2, the drive rollers 42, 44 of the sheet loosening unit 4, and the platen roller 50 and the discharge rollers 52 of the adhesive strength exhibiting unit 5 are driven by the common drive source such as a motor in synchronization with each other.

The above-mentioned rollers 20, 42, 44, 50, and 52 may have separate drive sources and may be driven independently from each other. For example, the drive rollers 42, 44 of the sheet loosening unit 4 may be driven immediately before the leading end of the label sheet S reaches the drive roller 42 on the upstream side by detecting the label sheet S with a sensor (not shown) set on the upstream side in the sheet-passage direction of the upstream sheet-passage part 40 or calculating the amount of sheet feed of the label sheet S by the above-mentioned platen roller 20. Further, similarly, the platen roller 50 may be driven immediately before the leading end of the adhesive label L reaches between the platen roller 50 and the thermal head 51 for exhibiting adhesive strength by detecting the adhesive label L with a sensor (not shown) set on the upstream side in the sheet transporting direction of the platen roller 50 of the adhesive strength exhibiting unit 5.

Next, the operation of the printer 1 having the above-mentioned configuration is described.

First, the printer 1 is prepared for operation. Specifically, the sheet roll R is set inside the roll accommodating part (not shown), and the end of the label sheet S is inserted between the platen roller 20 and the printing thermal head 21 of the printing unit 2.

In the case where a transporting roller is present on the upstream side in the sheet transporting direction of the printing unit 2, the end of the label sheet S is overlaid on the transporting roller.

Next, the printer 1 is connected to an external input device (not shown), and label information is output together with a label issuing instruction from the external input device to the printer 1. Examples of the label information include the length of the adhesive label L (or the printing data amount), printing data, and a heating adhesive strength exhibiting region. When the printer 1 receives the label issuing instruction and the label information, the drive source such as a motor (not shown) is driven, and the power of the drive source is transmitted to the platen roller 20 through the gear transmission mechanism (not shown) and the driven gear (not shown) to rotate the platen roller 20. Thus, the label sheet S sandwiched between the platen roller 20 and the printing thermal head 21 is sent to the cutter unit 3 side, and the label sheet S is transported while being unrolled from the sheet roll R. At this time, the printing thermal head 21 is driven to perform a printing operation in accordance with the label information. Consequently, a bar-code, characters, etc. are successively printed on the thermosensitive color-developing surface of the label sheet S passing between the platen roller 20 and the printing thermal head 21.

In the case where the printer 1 includes an input part, it is not necessary to connect the printer 1 to the external input device (not shown), and the printing unit 2 may be operated based on the label issuing instruction and the label information from the input part.

After the label sheet S having passed through the printing unit 2 passes between the fixed blade 30 and the movable blade 31 of the cutter unit 3, the label sheet S reaches the upstream sheet-passage part 40 of the sheet loosening unit 4. At this time, the drive roller 42 of the upstream sheet-passage part 40 is driven in synchronization with the drive of the platen roller 20 of the above-mentioned printing unit 2 to rotate the drive roller 42 and the driven roller 43, respectively. Therefore, the label sheet S is fed between the drive roller 42 and the driven roller 43 to be sent.

Further, at this time, as illustrated in FIG. 2A, the solenoid 62 of the sheet-passage direction changing means 6 is driven and the movable part 62*a* presses the connecting part 17 forward. In this manner, the lever member 14 is turned in the locking direction against the biasing force of the biasing member 61. The locking part 13 provided at the lever member 14 is placed at the locking position and locked at the shaft part 43*a* of the driven roller 43, and thus the driven roller 43 is held at the reference position. With this, the sheet-passage direction in the upstream sheet-passage part 40 and the sheet-passage direction in the downstream sheet-passage part 41 are directed on the identical line, and the downstream sheet-passage part 41 is present on the front side in the sheet-passage direction in the upstream sheet-passage part 40. Therefore, the label sheet S is easily passed from the upstream sheet-passage part 40 to the downstream sheet-passage part 41. Specifically, the label sheet S proceeds straight after being sent from the upstream sheet-passage part 40, and thus the leading end of the label sheet S reaches the downstream sheet-passage part 41. At this time, the drive roller 44 of the downstream sheet-passage part 41 is driven in synchronization with the drive of the platen roller 20 of the above-mentioned printing unit 2 to rotate the drive roller 44 and the driven roller 45, respectively. Therefore, the label sheet S is fed between the drive roller 44 and the driven roller 45 to be sent.

After that, the respective drive rollers 42 and 44 of the upstream sheet-passage part 40 and the downstream sheet-passage part 41 are driven, with the result that the label sheet S is unrolled from the sheet roll R until the cut position of the label sheet S to be the trailing end of the adhesive label L moves to the blade tip position of the cutter unit 3. At this time, by loosening the label sheet S between the upstream sheet-passage part 40 and the downstream sheet-passage part 41, the leading end of the label sheet S is prevented from proceeding to the position of the heating elements of the thermal head 51 for exhibiting adhesive strength of the adhesive strength exhibiting unit 5. Specifically, the rotation speed of the drive roller 44 of the downstream sheet-passage part 41 is set to be lower than that of the drive roller 42 of the upstream sheet-passage part 40, and the sheet feed amount per unit time to be fed by the downstream sheet-passage part 41 is set smaller than that to be fed by the upstream sheet-passage part 40. Thus, a part of the label sheet S between the upstream sheet-passage part 40 and the downstream sheet-passage part 41 is loosened in a mountain shape so as to swell to the thermosensitive color-developing surface side, and the loosened amount increases gradually along with the transportation of the label sheet S.

As means for loosening the label sheet S between the upstream sheet-passage part 40 and the downstream sheet-passage part 42, the drive roller 42 of the upstream sheet-passage part 40 may be driven while the drive of the drive roller 44 of the downstream sheet-passage part 41 is stopped.

Further, as illustrated in FIG. 2B, at a time point when the leading end of the label sheet S reaches the downstream sheet-passage part 41, the upstream sheet-passage part 40 is inclined from the reference position to the inclined position by the sheet-passage direction changing means 6 to change the sheet-passage direction in the upstream sheet-passage part 40.

Figure 5:
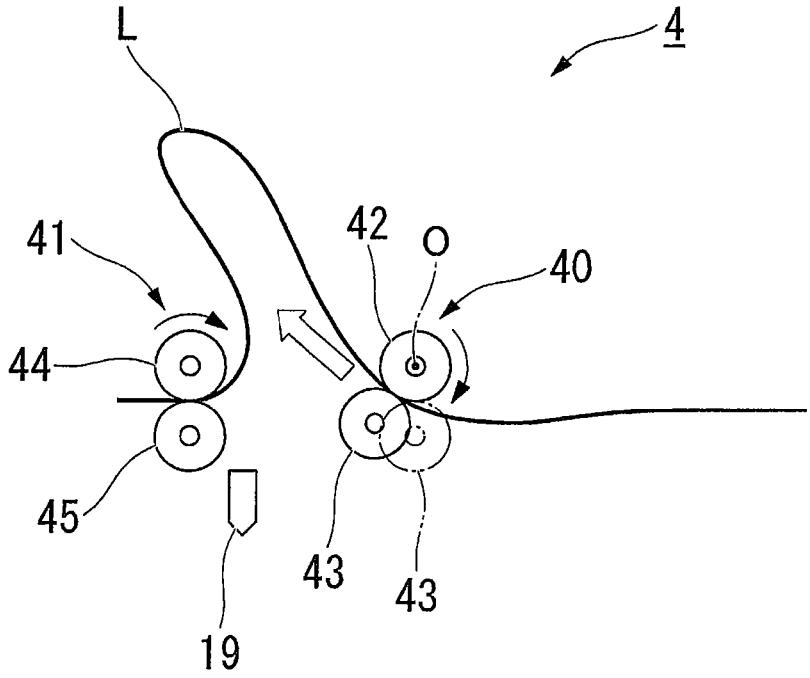
FIG. 5 is a schematic view illustrating a loosened state of a label sheet, which illustrates the first embodiment of the present invention.

More specifically, at a time point when the optical sensor 19 detects that the leading end of the label sheet S has reached the downstream sheet-passage part 41, the drive of the solenoid 62 of the sheet-passage direction changing means 6 is stopped to allow the movable part 62*a* to retract, and thus the pressing force against the connecting part 17 is released. Consequently, the lever member 14 is turned in the locking release direction by the biasing force of the biasing member 61, and the locking part 13 provided at the lever member 14 is removed from the shaft part 43*a* of the driven roller 43 to be placed at the release position. This allows the movement of the shaft part 43*a* of the driven roller 43 to the other end 12*b* side in the length direction of the guide hole 12. Therefore, the driven roller 43 is pushed up by the rotation force of the drive roller 42, and the shaft part 43*a* of the driven roller 43 moves from the position of the one end 12*a* to the position of the other end 12*b* in the length direction of the guide hole 12 along the guide hole 12. That is, the driven roller 43 turns around the rotation center shaft line O of the drive roller 42 to move from the reference position to the inclined position, and the sheet-passage direction between the drive roller 42 and the driven roller 43 is directed diagonally upward (open arrow direction illustrated in FIG. 5). Consequently, the loosened portion is not bent easily even when the loosened amount of the label sheet S increases, and transportation defects are prevented. More specifically, as illustrated in FIG. 5, when the loosened amount of the label sheet S increases, the loosened portion of the label sheet S is inclined toward the downstream side in the sheet-passage direction, and the loosened portion is not bent.

It is preferred to control whether or not to start the operation of changing the sheet-passage direction in the upstream sheet-passage part 40 by the above-mentioned sheet-passage direction changing means 6 in accordance with the label length for the label information. For example, in the case where the length dimension of the adhesive label L is equal to or smaller than the distance from the blade tip position of the cutter unit 3 to the downstream sheet-passage part 41, it is not necessary to loosen the label sheet S. Therefore, it is not necessary to change the direction of the sheet-passage in the upstream sheet-passage part 40 by the sheet-passage direction changing means 6, and the upstream sheet-passage part 40 may remain at the reference position. Further, even in the case where it is necessary to loosen the label sheet S, when the loosened amount is small, it is not necessary to change the direction of the sheet-passage in the upstream sheet-passage part 40 by the sheet-passage direction changing means 6, and the upstream sheet-passage part 40 may remain at the reference position.

After that, when the cut position (portion to be the trailing end of the adhesive label L) of the label sheet S proceeds up to the blade tip position of the cutter unit 3, the transportation of the label sheet S is stopped temporarily, and the portion to be the trailing end of the adhesive label L is cut by the cutter unit 3 to form the adhesive label L with a desired length.

More specifically, first, at a time point when the cut position of the label sheet S has moved up to the position of the blade tip of the fixed blade 30, the transportation of the label sheet S is stopped temporarily by stopping the drive source (not shown). As means for detecting that the cut position of the label sheet S has moved up to the position of the blade tip of the fixed blade 30, the cut position (trailing end of the adhesive label L) may be detected by an optical sensor (not shown) or a micro-chip (not shown) or detected based on the label length dimension from the label information and the calculated value of the sheet feed amount of the label sheet S.

Subsequently, the label sheet S is cut with the fixed blade 30 and the movable blade 31 by moving the movable blade 31 to the fixed blade 31 side. Thus, the adhesive label L with a desired length is cut from the label sheet S.

After that, the drive source (not shown) is driven again, and the drive rollers 42, 44 of the sheet loosening unit 4 are rotated respectively to transport the adhesive label L to the adhesive strength exhibiting unit 5 side.

Then, after the trailing end of the adhesive label L has passed through the upstream sheet-passage part 40, the upstream sheet-passage part 40 is returned from the inclined position to the reference position by the sheet-passage direction changing means 6 as illustrated in FIG. 2A, with the result that the sheet-passage direction in the upstream sheet-passage part 40 is returned to the original direction.

More specifically, after the trailing end of the label sheet S has passed between the drive roller 42 and the driven roller 43 on the upstream side, the drive source (not shown) is reversely driven (reversely rotated, for example, in the case of a motor) to reversely rotate the drive roller 42 of the upstream sheet-passage part 40 (rotate the drive roller 42 in a direction opposite to the direction at the time of transportation). This causes the driven roller 43 to be pushed up with the rotation force of the drive roller 42, and the shaft part 43*a* of the driven roller 43 moves from the position of the other end 12*b* to the position of the one end 12*a* in the length direction of the guide hole 12 along the guide hole 12. That is, the driven roller 43 turns around the rotation center shaft line O of the drive roller 42 to move from the inclined position to the reference position, and the sheet-passage direction in the upstream sheet-passage part 40 is returned to the original position, that is, the line identical to the sheet-passage direction in the downstream sheet-passage part 41.

When the driven roller 43 is returned to the reference position, the movement distance by the rotation of the drive roller 42 is previously calculated, and a period of time equal to or longer than the time taken for the movement distance (calculated value) is allowed to elapse or the driven roller 43 is fed by the feed amount or more of the movement distance, with the result that the driven roller 43 can be returned to the reference position. Further, a reference position detecting sensor such as a micro-switch (not shown) may be provided, and the reference position of the driven roller 43 may be detected by the sensor, to thereby return the driven roller 43 to the reference position without fail.

Subsequently, the solenoid 62 of the sheet-passage direction changing means 6 is driven again to allow the movable part 62*a* to proceed to press the connecting part 17 forward. Thus, the lever member 14 is turned in the locking direction against the biasing force of the biasing member 61, and the locking part 13 provided at the lever member 14 moves to the locking position to be hooked on the shaft part 43*a* of the driven roller 43. This regulates the movement of the shaft part 43*a* of the driven roller 43 placed at the position of the one end 12*a* in the length direction of the guide hole 12 toward the other end 12*b* in the length direction of the guide hole 12.

After that, the drive of the drive source (not shown) is returned to the forward direction to rotate the drive roller 44 of the downstream sheet-passage part 41 of the sheet loosening unit 4, and the adhesive label L is transported to the adhesive strength exhibiting unit 5 side. At this time, the drive roller 42 of the upstream sheet-passage part 40 rotates in the transporting direction. However, as described above, the movement of the shaft part 43*a* of the driven roller 43 toward the other end 12*b* in the length direction of the guide hole 12 is regulated, and hence the driven roller 43 is held at the reference position without being pushed up by the drive roller 42.

Next, the adhesive label L sent from the downstream sheet-passage part 41 is inserted between the platen roller 50 and the thermal head 51 for exhibiting adhesive strength of the adhesive strength exhibiting unit 5. Then, the adhesive label L sandwiched between the platen roller 50 and the thermal head 51 for exhibiting adhesive strength is sent to the discharge rollers 52, 52 side. At this time, the adhesive surface of the adhesive label L is heated by the thermal head 51 for exhibiting adhesive strength, and the adhesive strength of the adhesive label L is exhibited.

Then, the adhesive label L sent from between the platen roller 50 and the thermal head 51 for exhibiting adhesive strength is transported to the discharge port side (not shown) by the discharge rollers 52, 52 to be discharged through the discharge port.

Further, as described above, it is preferred that, after the label sheet S is cut by the cutter unit 3, the platen roller 20 of the printing unit 2 be rotated reversely, and the cut label sheet S be returned to adjust the printing start position of the label sheet S to the position of the printing thermal head 21. Further, a sensor (not shown) for detecting the leading end of the label sheet S is set in the printing unit 2, and the leading end of the label sheet S is returned to the position of the sensor to allow the sensor to detect (recognize) the leading end of the label sheet S, and the printing start position of the label sheet S is moved to the position of the printing thermal head 21, with the result that positioning can be performed with good precision.

Further, in synchronization with the drive of the platen roller 20 of the printing unit 2, the platen roller 50 and the discharge rollers 52, 52 of the adhesive strength exhibiting unit 5 are driven to rotate. That is, the driven gear (not shown) fixed to one end of the platen roller 20 of the printing unit 2, the driven gear (not shown) fixed to each one end of the two drive rollers 42, 44 of the sheet loosening unit 4, the driven gear (not shown) fixed to one end of the platen roller 50 of the adhesive strength exhibiting unit 5, and the driven gear (not shown) fixed to one end of the discharge roller 52 mesh with the same gear transmission mechanism, and the platen roller 20 of the printing unit 2, the drive rollers 42, 44 of the sheet loosening unit 4, and the platen roller 50 and the discharge roller 52 of the adhesive strength exhibiting unit 5 are driven with one drive source.

In the case where the respective rollers 20, 42, 44, 50, and 52 have separate drive sources, it is not necessary to drive the respective rollers 20, 42, 44, 50, and 52 in synchronization with each other. For example, the drive rollers 42, 44 of the sheet loosening unit 4 may be driven immediately before the leading end of the label sheet S reaches the drive roller 42 on the upstream side by allowing a sensor (not shown) set on the upstream side in the sheet-passage direction of the upstream sheet-passage part 40 to detect the label sheet S or calculating the feed amount of the label sheet S by the platen roller 20. Further, during the cut operation, even when the drive roller 42 is stopped, the drive roller 44 may remain driven. Similarly, the platen roller 50 may be driven immediately before the leading end of the adhesive label L reaches the region between the platen roller 50 and the thermal head 51 for exhibiting adhesive strength by detecting the adhesive label L with a sensor (not shown) set on the upstream side in the sheet transporting direction of the platen roller 50 of the adhesive strength exhibiting unit 5.

In the above-mentioned printer 1 (adhesive label issuing device 10), the sheet-passage direction changing means 6 changes the direction of the upstream sheet-passage part 40 from the reference position to the inclined position to change the sheet-passage direction of the upstream sheet-passage part 40, with the result that a loosened portion is not bent easily even when the loosened amount of the label sheet S increases, and transportation defects such as sheet jam can be prevented. Therefore, the reliability of the printer 1 (adhesive label issuing device 10) can be enhanced. Further, even when the loosened amount of the label sheet S increases, a loosened portion is not bent easily, and transportation defects such as sheet jam is prevented. Therefore, the adhesive label L having a large size and the adhesive label L having a small size can be widely handled by reducing the interval between the upstream sheet-passage part 40 and the downstream sheet-passage part 41, and the degree of freedom of the length of the adhesive label L can be enhanced. Further, the printer 1 (adhesive label issuing device 10) can be downsized by reducing the interval between the upstream sheet-passage part 40 and the downstream sheet-passage part 41.

Further, the printing unit 2 is provided on the upstream side in the sheet transporting direction of the cutter unit 3, and after printing is performed on the thermosensitive color-developing surface of the label sheet S by the printing unit 2, the label sheet S is cut to the adhesive label L with a desired length by the cutter unit 3. Then, the adhesive label L is issued after the adhesive strength thereof is exhibited by the adhesive strength exhibiting unit 5. Thus, printing is performed by the printing unit 2 before the label sheet S is loosened by the sheet loosening unit 4, and hence the printing precision can be enhanced.

Further, the upstream sheet-passage part 40 is formed of a pair of transporting rollers (drive roller 42 and driven roller 43), and the label sheet S is inserted between the drive roller 42 and the driven roller 43. Therefore, the label sheet S can be transported or loosened without fail.

Further, the sheet-passage direction of the label sheet S passing through the region between the drive roller 42 and the driven roller 43 is changed by turning the driven roller 43 around the rotation center shaft line O of the drive roller 42 by the turning mechanism 11. Therefore, the sheet-passage direction in the upstream sheet-passage part 40 can be changed with a simple mechanism.

Further, in the turning mechanism 11, the locking part 13 is removed from the shaft part 43*a* of the driven roller 43 by the release mechanism 60 and the drive roller 42 is rotated, with the result that the driven roller 43 is turned around the rotation center shaft line O of the drive roller 42 along the guide hole 12 due to the rotation force of the drive roller 42, and the direction of the upstream sheet-passage part 40 is changed from the reference position to the inclined position. Then, when the drive roller 42 is rotated reversely, the driven roller 43 is turned around the rotation center shaft line O of the drive roller 42 along the guide hole 12 due to the rotation force of the drive roller 42, and the direction of the upstream sheet-passage part 40 is returned from the inclined position to the reference position. After that, the direction of the upstream sheet-passage part 40 is maintained at the reference position by locking the shaft part 43*a* of the driven roller 43 by the locking part 13. Thus, with a simple configuration, the driven roller 43 can be turned around the rotation center shaft line O of the drive roller 42 between the reference position and the inclined position.

Second Embodiment

Figure 6:
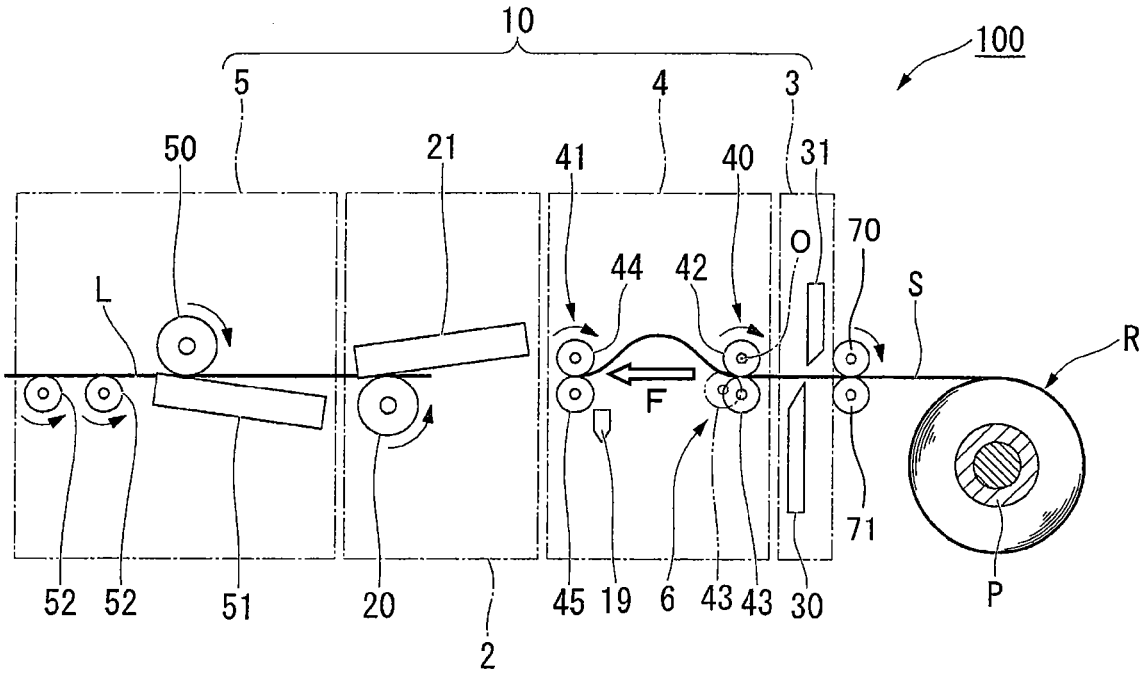
FIG. 6 is a schematic view of a printer, which illustrates a second embodiment of the present invention.

A printer 100 illustrated in FIG. 6 is an adhesive label issuing device according to a second embodiment of the present invention, and as a schematic configuration, the printer 100 includes a cutter unit 3 for cutting a label sheet S unrolled from a sheet roll R to obtain an adhesive label L with a desired length by allowing the label sheet S to pass therethrough, a sheet loosening unit 4 for loosening the label sheet S having passed through the cutter unit 3, a printing unit 2 for performing printing on a thermosensitive color-developing surface of the adhesive label L cut by the cutter unit 3 by heating the adhesive label L from the thermosensitive color-developing surface side (upper side in FIG. 1), and an adhesive strength exhibiting unit 5 for exhibiting the adhesive strength of the adhesive label L printed by the printing unit 2 by heating the adhesive label L from an adhesive layer side (reverse side of the thermosensitive color-developing surface, that is, a lower side in FIG. 1). That is, in the printer 100 of this embodiment, the printing unit 2 is placed between the sheet loosening unit 4 and the adhesive strength exhibiting unit 5, that is, on the downstream side in the sheet transporting direction of the sheet loosening unit 4 and the upstream side in the sheet transporting direction of the adhesive strength exhibiting unit 5.

Further, a pair of transporting rollers 70, 71 sandwiching the label sheet S are provided on the upstream side in the sheet transporting direction of the cutter unit 3. The label sheet S is sent to the cutter unit 3 side by the pair of transporting rollers 70, 71, with the result that the label sheet S is transported while being unrolled from the sheet roll R.

The configuration of each unit described above (printing unit 2, cutter unit 3, sheet loosening unit 4, and adhesive strength exhibiting unit 5) is similar to that of the first embodiment, and hence the description thereof is omitted.

In the above-mentioned printer 100, the label sheet S unrolled from the sheet roll R passes through the cutter unit 3 and is cut to the adhesive label L with a desired length. After that, the adhesive label L is transported to the printing unit 2, and printing is performed on the thermosensitive color-developing surface by the printing unit 2. Then, the printed adhesive label L is issued with the adhesive strength exhibited by the adhesive strength exhibiting unit 5. Therefore, the length of the label sheet S unrolled from the sheet roll R becomes small. This can prevent inconvenience such as the elongation and fracture of the label sheet S.

The adhesive label issuing device of the present invention has been described above with reference to the first and second embodiments. However, the present invention is not limited to those embodiments, and modifications may be made thereto as appropriate without departing from the gist of the present invention.

For example, in the above-mentioned embodiments, the printer 1 including the adhesive label issuing device 10 and the printing unit 2 is described. However, according to the present invention, the adhesive label issuing device 10 may be provided alone. For example, in the case of using a sheet roll R in which printing has already been performed on the thermosensitive color-developing surface of the label sheet S, the printing unit may be omitted.

Figure 7A:
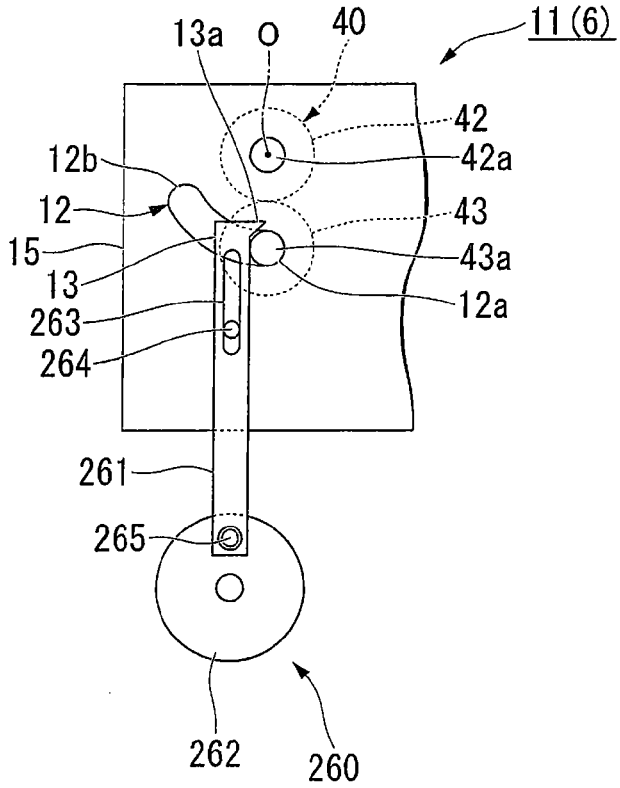
FIGS. 7A and 7B are side views of the sheet-passage direction changing means (turning mechanism), which illustrate a modified example of the present invention.
Figure 7B:
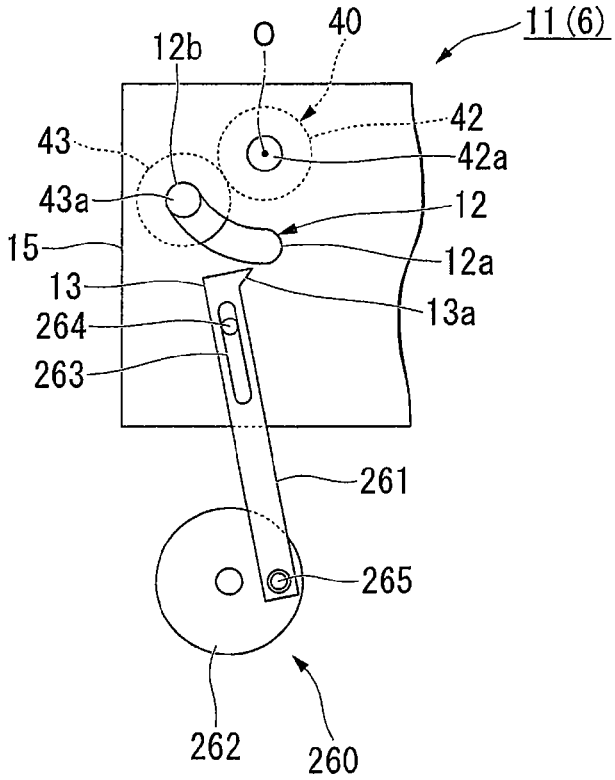

Further, in the above-mentioned embodiments, the release mechanism 60 for moving the locking part 13 in the direction in which the locking part 13 is removed from the driven roller 43, to thereby release the locking of the locking part 13 with respect to the driven roller 43 includes the biasing member 61 for biasing the lever member 14 in the direction in which the locking part 13 moves from the locking position to the release position, and the solenoid 62 for pressing the lever member 14 in the direction in which the locking part 13 moves from the release position to the locking position against the biasing force of the biasing member 61. The present invention may have a release mechanism having another configuration. For example, as illustrated in FIGS. 7A and 7B, a release mechanism 260 may be used, in which a rotatable cam 262 is connected to the end of an arm member 261 having the locking part 13. The arm member 261 is provided with a long hole 263 extending in the longitudinal direction, and a fixed shaft 264 fixed to the frame plate 15 is inserted in the long hole 263. The arm member 261 and the cam 262 are connected to each other through a rotatable rotation shaft 265. In a turning mechanism 211 including the release mechanism 260 having such a configuration, the arm member 261 swings while the fixed shaft 264 in the long hole 263 is being displaced and the locking part 13 provided at the arm member 261 moves between a locking position (illustrated in FIG. 7A) and a release position (illustrated in FIG. 7B) by rotating the cam 262 with a drive source such as a motor. Further, the movement of the driven roller 43 in the long hole is not limited to the one caused by the rotation of the drive roller 42, and movement means using swing such as the above-mentioned arm member may be used.

Further, in the above-mentioned embodiments, the thermal head 51 for exhibiting adhesive strength is provided as a heat source in the adhesive strength exhibiting unit 5, but the present invention may also use a heat source other than the thermal head 51 for exhibiting adhesive strength, and for example, the adhesive surface of the adhesive label L may be heated through use of a heat roller.

Further, in the above-mentioned embodiments, the upstream sheet-passage part 40 and the downstream sheet-passage part 41 are formed of the drive rollers 42, 44 and the driven rollers 43, 45, respectively, but according to the present invention, at least one of the upstream sheet-passage part and the downstream sheet-passage part may have another configuration. For example, the upstream sheet-passage part or the downstream sheet-passage part may be formed of a pair of guide plates in which the label sheet S or the adhesive label L is inserted.

Further, in the above-mentioned embodiments, the printer 1, 100 is described in which the label sheet S having an adhesive layer made of a thermally activated adhesive is used, and the adhesive layer is thermally activated by the adhesive strength exhibiting unit 5 to allow the adhesive label L to exhibit adhesive strength, but the present invention may also use a label sheet with another configuration. For example, a label sheet with a configuration in which the adhesive layer is covered with a coating layer may also be used. In this case, the adhesive strength of the adhesive label can be exhibited by removing the coating layer by the adhesive strength exhibiting unit to expose the adhesive layer.

Besides the above, the components in the above-mentioned embodiments may be replaced by well-known components as appropriate without departing from the gist of the present invention. The above-mentioned modified examples may be combined as appropriate.

What is claimed is:

1. An adhesive label issuing device, comprising:

a cutter unit for cutting a label sheet having a band shape, in which an adhesive layer is provided on a reverse side of a thermosensitive color-developing surface of thermosensitive paper, to obtain an adhesive label with a desired length by allowing the label sheet to pass through the cutter unit;

an adhesive strength exhibiting unit for allowing the adhesive label to exhibit adhesive strength by heating the adhesive label from the reverse side of the thermosensitive color-developing surface; and a sheet loosening unit placed on a downstream side of the cutter unit and an upstream side of the adhesive strength exhibiting unit in a sheet transporting direction, for loosening the label sheet having passed through the cutter unit without being cut between an upstream sheet-passage part and a downstream sheet-passage part that respectively allow the label sheet to pass therethrough, wherein the upstream sheet-passage part has a reference position at which a sheet-passage direction in the upstream sheet-passage part is placed on the same line as a sheet-passage direction in the downstream sheet-passage part, and wherein the adhesive label issuing device further comprises sheet-passage direction changing means for changing the sheet-passage direction in the upstream sheet-passage part by changing a direction of the upstream sheet-passage part from the reference position to an inclined position at which the direction is inclined from the reference position.

2. An adhesive label issuing device according to claim 1, wherein the upstream sheet-passage part comprises a pair of transporting rollers, and the label sheet is allowed to pass through a region between the pair of transporting rollers.

3. An adhesive label issuing device according to claim 2, wherein one of the pair of transporting rollers comprises a drive roller and another of the pair of transporting rollers comprises a driven roller following the drive roller, and wherein the sheet-passage direction changing means comprises a turning mechanism for turning the driven roller around a rotation center shaft line of the drive roller to move the driven roller between the reference position and the inclined position.

4. An adhesive label issuing device according to claim 3, wherein the turning mechanism comprises:

a guide hole which extends in an arc shape with the rotation center shaft line of the drive roller being a center and in which a shaft part of the driven roller is inserted;

a locking part for locking the driven roller placed at the reference position; and a release mechanism for moving the locking part in a direction in which the locking part is removed from the driven roller, to thereby release locking of the locking part with respect to the driven roller.

5. A printer, comprising:

the adhesive label issuing device according to claim 1; and a printing unit provided on an upstream side in the sheet transporting direction of the cutter unit, for performing printing on the thermosensitive color-developing surface by heating the label sheet from the thermosensitive color-developing surface side.

6. A printer, comprising:

the adhesive label issuing device according to claim 4; and a printing unit provided on an upstream side in the sheet transporting direction of the cutter unit, for performing printing on the thermosensitive color-developing surface by heating the label sheet from the thermosensitive color-developing surface side.

7. A printer, comprising:

the adhesive label issuing device according to claim 1; and a printing unit provided on a downstream side in the sheet transporting direction of the downstream sheet-passage part and an upstream side in the sheet transporting direction of the adhesive strength exhibiting unit, for performing printing on the thermosensitive color-developing surface by heating the adhesive label from the thermosensitive color-developing surface side.

8. A printer, comprising:

the adhesive label issuing device according to claim 4; and a printing unit provided on a downstream side in the sheet transporting direction of the downstream sheet-passage part and an upstream side in the sheet transporting direction of the adhesive strength exhibiting unit, for performing printing on the thermosensitive color-developing surface by heating the adhesive label from the thermosensitive color-developing surface side.

* * * * *